United States Patent [19]

Coppens

[11] Patent Number: 4,824,291

[45] Date of Patent: Apr. 25, 1989

[54] OFFSHORE TOWER STRUCTURES

[75] Inventor: Anton Coppens, Oegstgeest, Netherlands

[73] Assignee: Heerema Engineering Service BV, Vondellaan, Netherlands

[21] Appl. No.: 155,368

[22] Filed: Feb. 12, 1988

[30] Foreign Application Priority Data

Feb. 12, 1987 [GB] United Kingdom ..... 8703222

[51] Int. Cl.[4] ..... E02B 17/00

[52] U.S. Cl. ..... 405/204; 405/205; 405/224

[58] Field of Search ..... 405/195, 203, 204, 224, 405/227, 205, 209

[56] References Cited

U.S. PATENT DOCUMENTS 3,572,044 3/1971 Pogonowski ..... 405/204

*Primary Examiner*—David H. Corbin

*Attorney, Agent, or Firm*—Fulwider, Patton, Rieber, Lee & Utecht

[57] ABSTRACT

A method of assembly of an offshore tower comprises engaging a column with a sleeve of a support structure by positioning the column so that its longitudinal axis is vertical or nearly vertical, positioning the support structure so that the column-receiving sleeve is uppermost and the axis of the sleeve is vertical or nearly vertical, with the sleeve above the top of the column, and positioning the column in the sleeve by relative longitudinal movement between the column and support structure.

9 Claims, 9 Drawing Sheets

OFFSHORE TOWER STRUCTURES

This invention relates to methods of assembly of offshore tower structures.

BACKGROUND OF THE INVENTION

More particularly, the invention is concerned with an offshore tower structure of the kind comprising a central column to extend upwardly in use from the sea bed to support a platform and carry services such as conductors and risers between the sea bed and the platform, and a structure to support the column, the support structure including at least three legs joined at their apex by a sleeve which in use surrounds and supports the column above the sea bed. Such a structure is herein referred to as an "offshore tower structure of the kind defined."

An example of an offshore tower structure of the kind defined is seen in our British Pat. No. 2136860. In this example, the support structure has both upper and lower sleeves for slidably receiving the column. Assembly of this structure is by sliding one end of the column through both the sleeves and fixing, for example, by introducing grout between the column and sleeves.

Another example of an offshore tower structure of the kind defined is seen in our British Pat. No. 2116237. In this example, the support structure includes bracing to provide additional strength and foundations for the column and legs can be pre-installed on the sea bed.

The present invention offers an alternative assembly technique which is suitable, for example, for occasions where the central column is too large to be lifted by an available crane vessel.

BRIEF SUMMARY OF THE INVENTION

The invention provides a method of assembly of an offshore tower structure of the kind defined in which the column is engaged with the sleeve of the support structure by positioning the column so that its longitudinal axis is vertical or nearly vertical, positioning the support structure so that the sleeve is uppermost and the axis of the sleeve is vertical or nearly vertical, with the sleeve above the top of the column, and positioning the column in the sleeve by relative movement of the column and support structure.

By way of example, various embodiments of the invention will now be described with reference to the accompanying drawings.

DESCRIPTION OF THE PREFERRED EMBODIMENTS

Figure 1A:
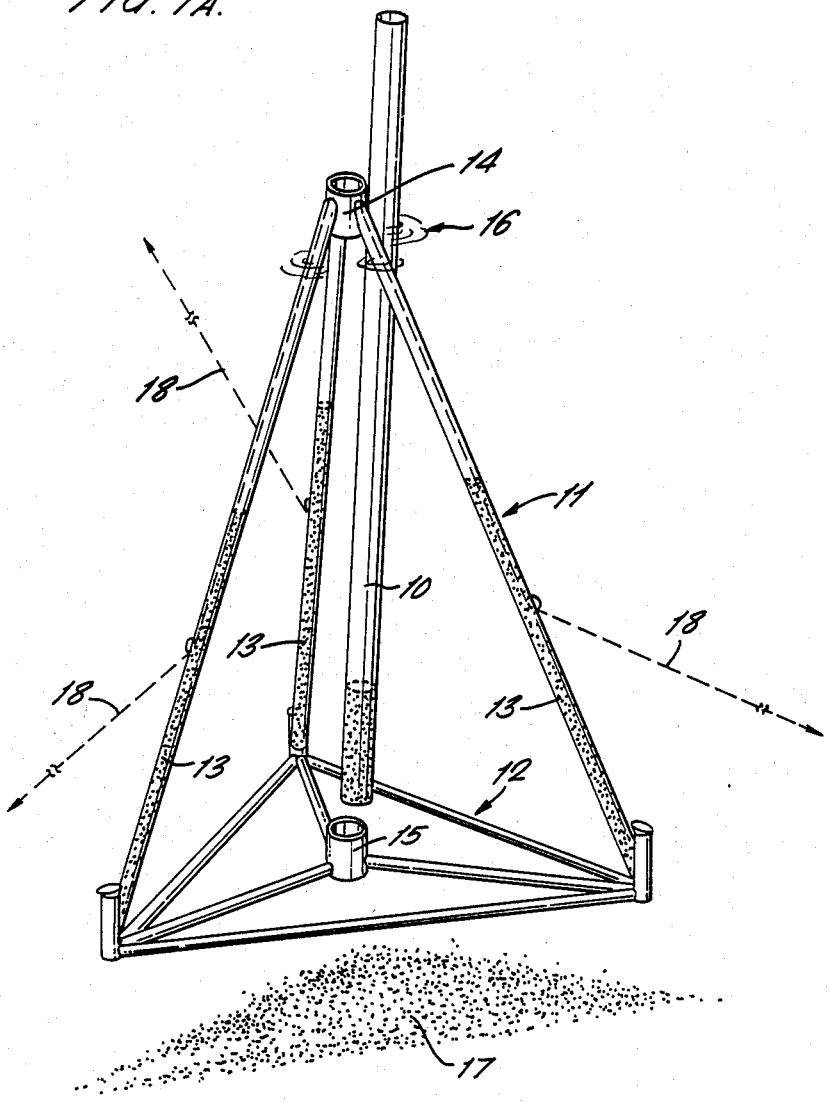
FIGS. 1A to 1E illustrate one form of offshore tower structure in various stages of construction and using various assembly methods.

There is seen in FIGS. 1A to 1E a central column 10 and an integral pre-formed support structure 11. The support structure 11 here comprises three support legs 13 which are joined at their apex by a column-receiving sleeve 14. The lower ends of the legs 13 are connected by a structure 12 which serves as a foundation when thestructure is on the sea bed. The foundation structure 12 includes a lower column receiving sleeve 15. It will be seen that the support structure 11 is of pyramind shape, and it will be understood that the structure may comprise more than three legs. The column 10 and support structure 11 can be ballasted and de-ballasted by flooding/draining water from the legs and column, which are hollow tubular members. The water ballast in the column and legs is illustrated by the shaded areas in the drawings. The level of the water above the sea bed is illustrated pictorially in the drawings by surface ripples 16, and the sea bed is illustrated pictorially by a shadow 17.

Figure 1B:
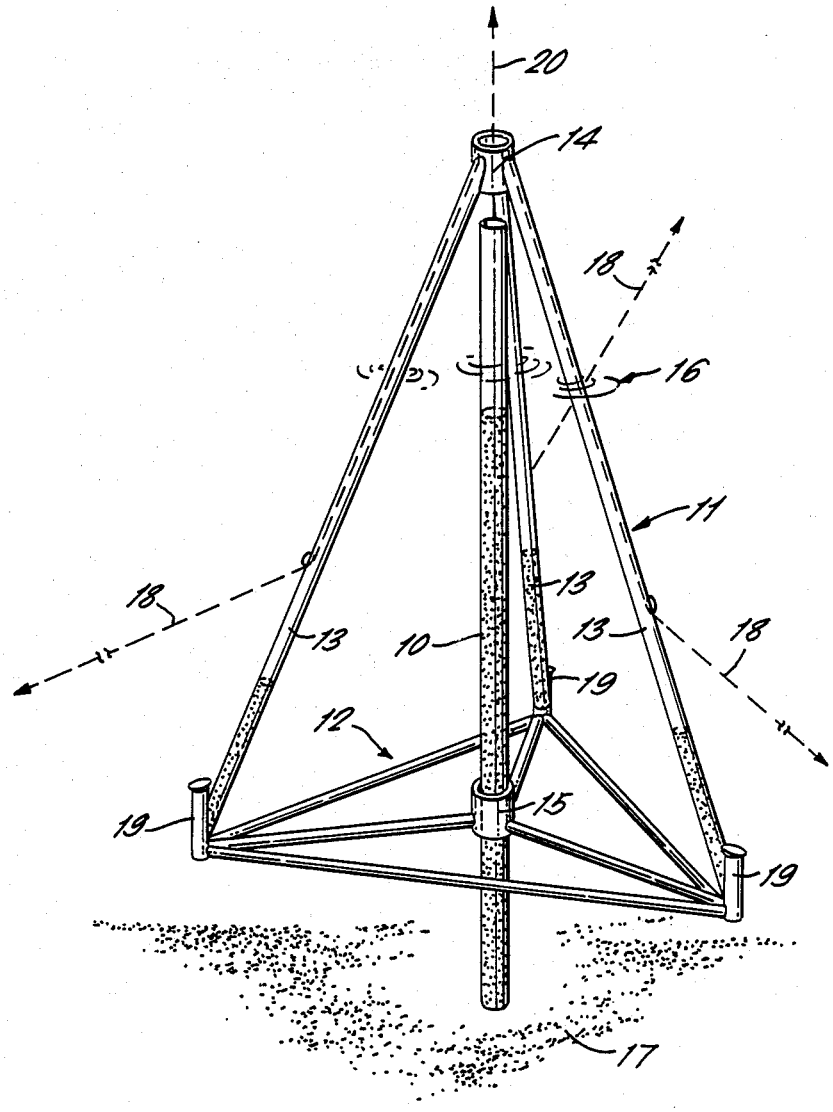

In the method of assembly illustrated in FIG. 1A, the column 10 is floating and positioned with its longitudinal axis vertical. The support structure 11 is also floating, but is positioned at a slightly inclined angle to the vertical. This allows room for the first assembly step, as described below. The support structure 11 is held in position by means of lines 18, which may be anchor lines or lines to vessels such as tug boats. A fender (not seen in FIG. 1A) is interposed between the column 10 and the upper sleeve 14 to prevent collision damage. The first assembly step is to position the bottom of the column 10 directly over the lower sleeve 15, as seen in FIG. 1A. The column 10 is then engaged with the lower sleeve 15, as seen in FIG. 1B, by relative longitudinal movement between the column and sleeve. This may be done by ballasting the column 10 or deballasting the support structure 11 or by a combination of both. It will be appreciated here that the lower sleeve 15 has sufficient clearance to allow for the fact that the column is out of alignment relative to the axis of the sleeve, as can be seen in FIG. 1A. With the column now in engagement with the lower sleeve 15, the column is then brought into alignment with the upper sleeve, as seen in FIG. 1B. The column 10 is then engaged with the upper sleeve 14 by relative longitudinal movement between the column and sleeve. This may again be done by suitable ballasting/deballasting of the column and/or support structure. Alternatively or additionally, a pulling force may be used for engagement of the column with the sleeves, e.g. from a vessel such as a crane vessel, or from a specially installed winch deck on the top of the support structure. Such a pulling force is illustrated by reference 20 in FIG. 1B. After thus assembling the column and support structure together, the two are rigidly fixed together, e.g. by filling the spaces between the column and sleeves with grout. This can be done with the assembled structure still in its vertical position or in a horizontal position, after deballasting. The assembled structure is then lowerable into position on the sea bed where it can be anchored by driving piles through pile sleeves 19 provided in the foundation structure 12.

It will be understood that it is not essential though it may be desirable, for either the column or the support structure to be exactly vertical during assembly.

Figure 1C:
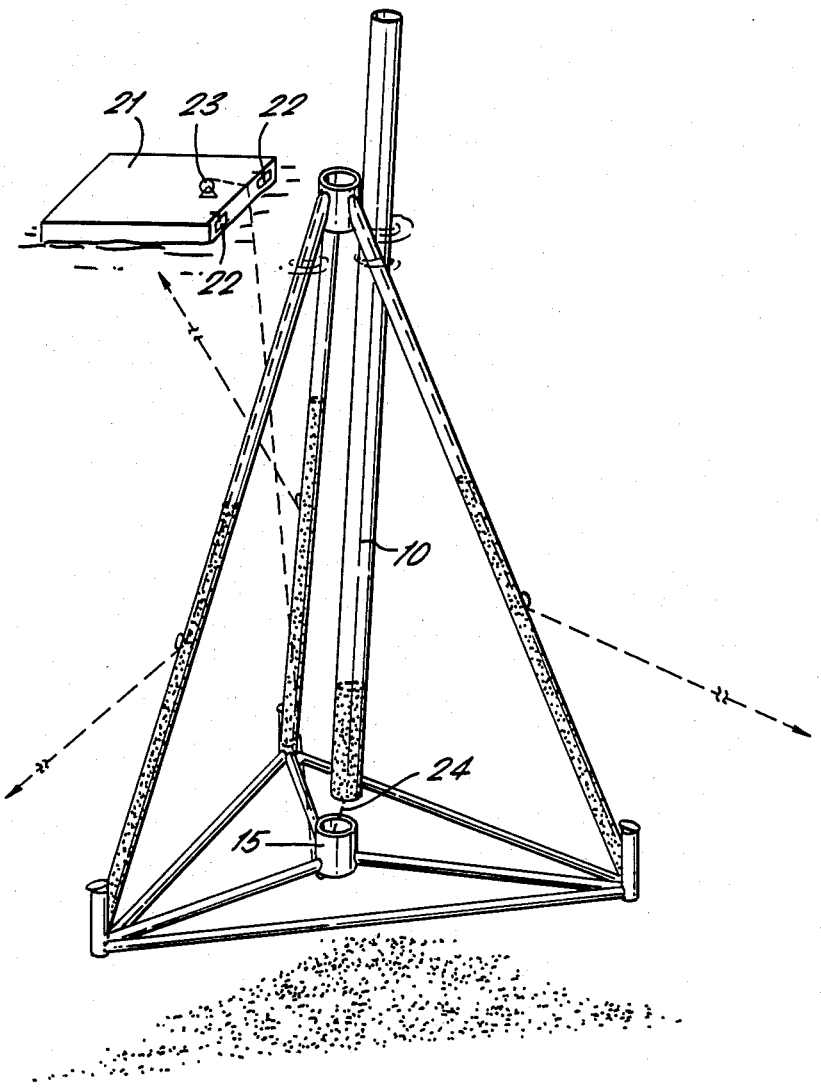

FIG. 1C shows use being made of an assisting vessel 21, with suitable fenders 22, and a winch 23.

The winch is used here to control line 24, which is attached to the base of the column 10, to aid engagement of the base of the column with the lower sleeve 15.

Figure 1D:
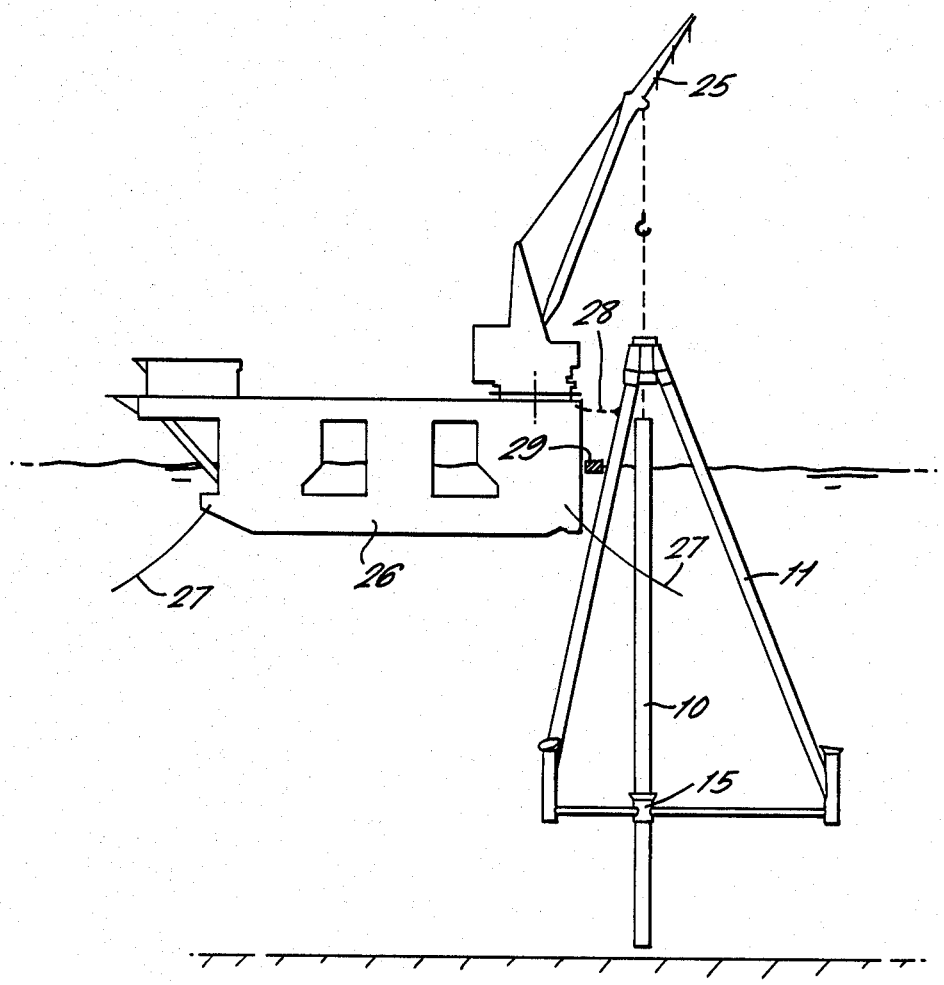

FIG. 1D shows lifting of the central column 10 using the crane boom 25 of a crane vessel 26 after engagement of the column with the lower sleeve 15. The vessel 26 is anchored by lines 27 and holds the support structure 11 in position by line 28. 29 represents a fender.

Figure 1E:
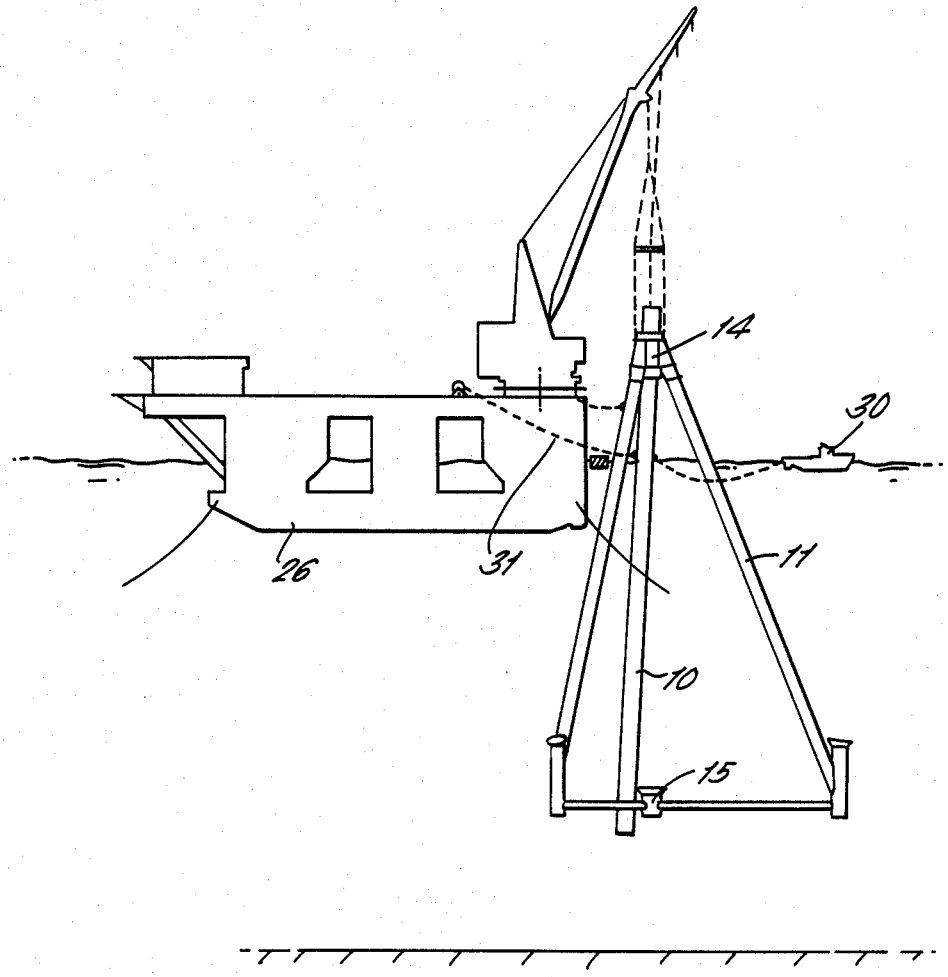

FIG. 1E shows an alternative assembly method. Again, the column 10 is positioned with its longitudinal axis vertical and the support structure 11 slightly offset from the vertical. Here, the column 10 is first engaged with the upper sleeve 14 of the support structure 11. This is done by positioning the support structure 11 with the upper sleeve 14 immediately above the top of the column 10 and moving the column and sleeve longitudinally relative to each other. This can be achieved by using the crane vessel 26 seen in FIG. 1E to lift the column 10. Additionally or alternatively, the column 10 and/or support structure 11 may be suitably ballasted/-deballasted. Horizonal position control for the upper end of the column may be provided by a tug 30 or tugs and tugger lines 31 or by anchor lines. It will be appreciated here that it is the upper sleeve 14 which must have sufficient clearance to allow for the fact that the column is out of alignment with the axis of the sleeve upon engagement, as can be seen clearly in FIG. 1E. The lower end of the column 10 can be left to find its own horizontal position by gravity for engagement of the column with the lower sleeve 15.

Figure 2:
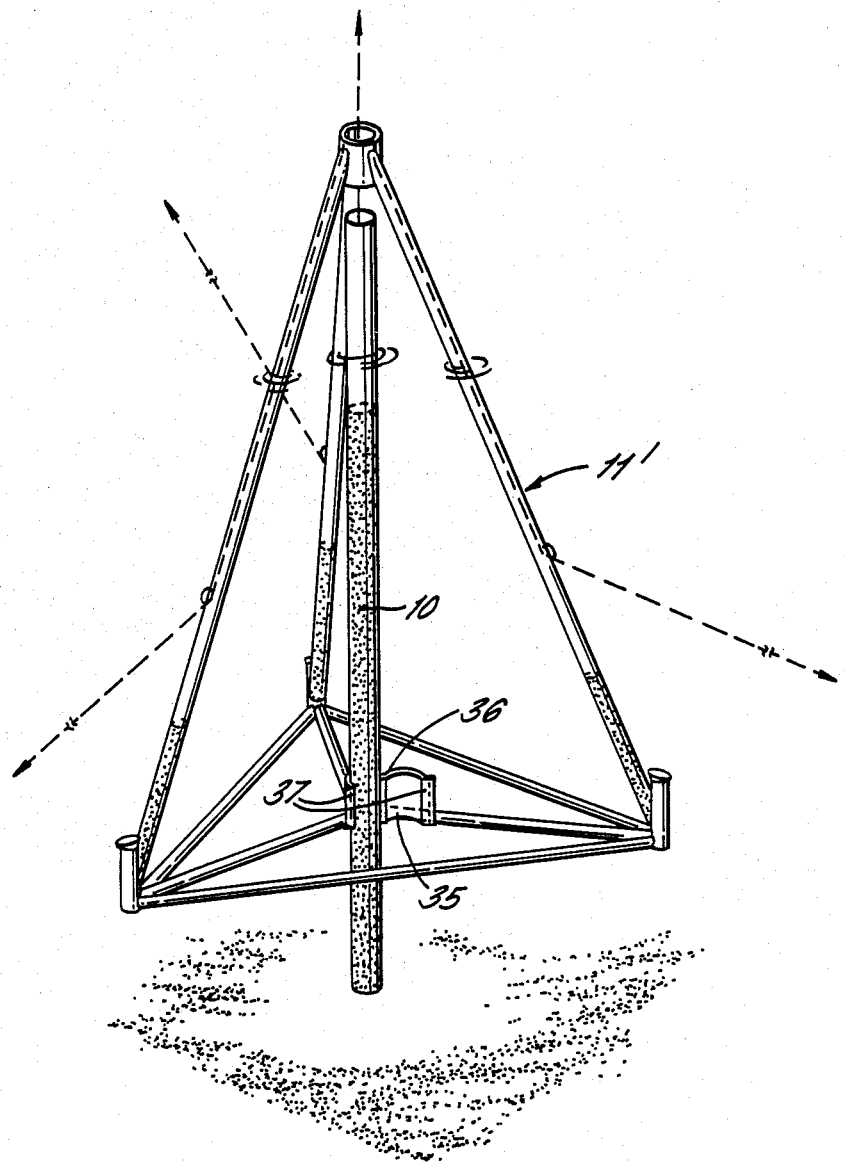
FIGS. 2 to 5 illustrate alternative constructions and assembly methods.

In FIG. 2 there is seen a modified version of the support structure shown in FIG. 1A. In the support structure 11' shown in FIG. 2, the lower location for the column 10 is provided in the form of an openable and closable collar 35. The collar 35 is in two parts which are connected together by a hinge 36 and which have flanges 37 to receive clamping bolts. The column here is engaged with the lower location by simple relative lateral movement between the column and the open collar. The collar can then be closed and bolted.

Figure 3:
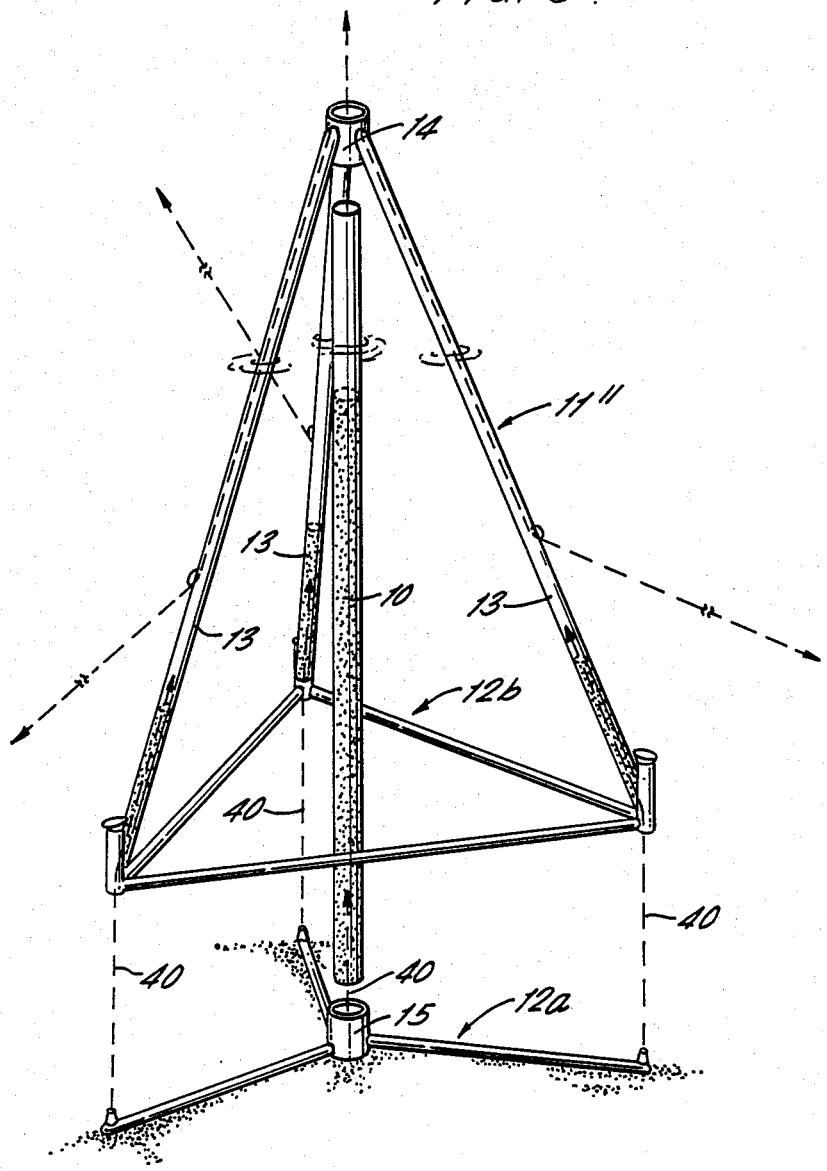

In FIG. 3 there is seen a further modified version of the support structure shown in FIG. 1A. In the support structure 11" shown in FIG. 3, the foundation structure is in two parts **12*a* and 12*b*. The upper part 12*b* is preformed integrally with the support legs 13 and upper sleeve 14, whereas the lower part 12*a* is separate and incorporates the lower sleeve 15. The lower part 12*a* here can be pre-installed in position on the sea bed whilst the column 10 and upper part 12*a* of the support structure are assembled. Positioning/guiding lines 40 are conveniently used for assembling together the two parts of the foundation structure during installation, as can be seen in FIG. 3**.

Figure 4:
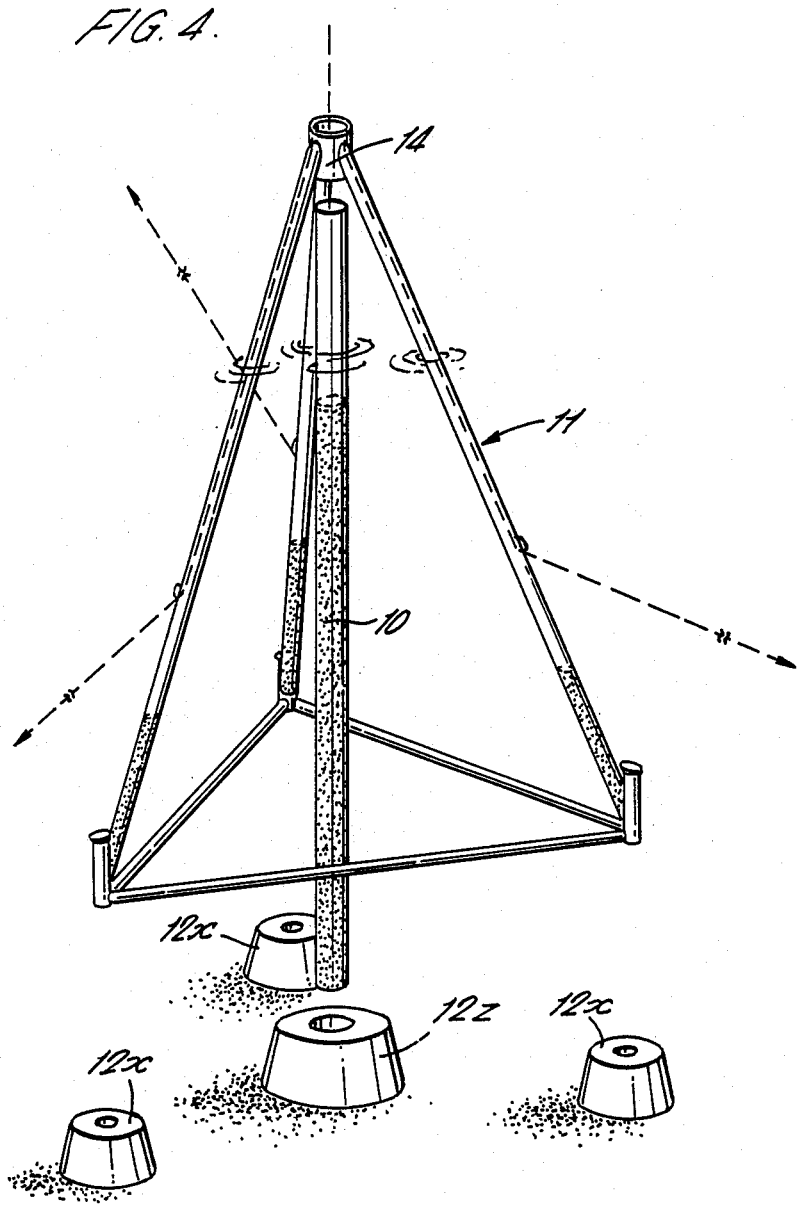

FIG. 4 is similar to FIG. 3 and shows the case where individual foundation units 12X and 12Z may be provided for the legs and column and pre-installed on the sea bed.

Figure 5:
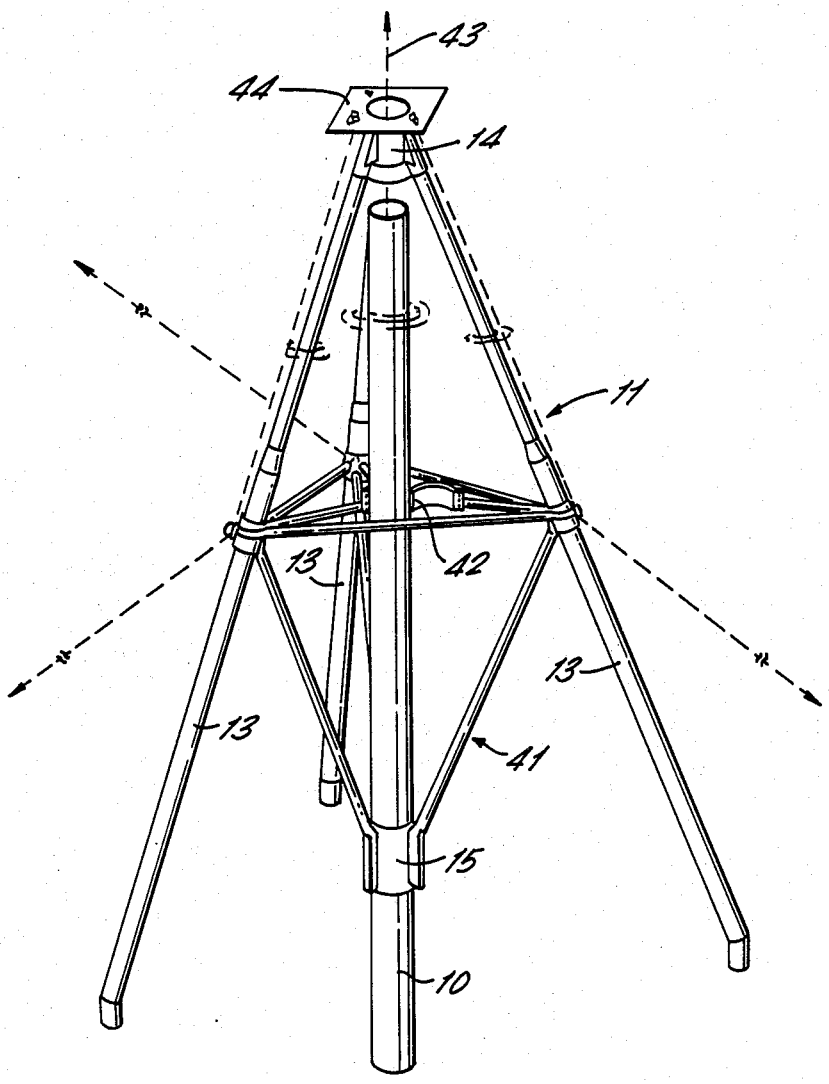

In FIG. 5 there is seen a somewhat different construction. Here again three support legs 13 are formed into a support structure 11 for the column 10 with an upper sleeve 14 at their apex for slidingly receiving the column. In addition, however, between the legs 13 and between the column 10 and legs there is provided a bracing structure 41 comprising an arrangement of stiffening struts. As can be seen in FIG. 5, a lower sleeve 15 is provided for the column at the bottom of the bracing structure 41 and a collar 42 is provided at the top of the bracing structure. The collar 42 is similar to that seen in FIG. 2, being openable and closable with hinged parts and flanges for clamping bolts. The structure is seen in FIG. 5 at an intermediate stage of construction with the lower end of the column 10 having been located in the lower sleeve 15 and engaged with the collar 42. The column 10 is about to be engaged with the upper sleeve 14. This may be effected by pulling with line and winch in the direction of arrow 43, as seen in FIG. 5. For this purpose, a temporary winch deck 44 may be incorporated onto the top of the upper sleeve 14 of the support structure 11. The deck 44 may also be used to position the mooring winches. It will again be appreciated here that the sleeve into which the column is first engaged (i.e. upper sleeve 14 or lower sleeve 15) will have sufficient clearance to allow for the offset of the column. After the column and support structure have been assembled together, the entire assembly can then be lowered onto a foundation unit or units which has been pre-installed on the sea bed.

What I claim is:

1. A method of assembly of an offshore tower structure of the kind comprising a central column to extend upwardly in use from the sea bed to support a platform and carry services such as conductors and risers between the sea bed and the platform, and a structure to support the column, the support structure including at least three legs joined at their apex by a column-receiving sleeve which in use surrounds and supports the column above the sea bed, which method includes the steps of positioning the column in the water with its longitudinal axis vertical or nearly vertical, positioning the support structure in the water with the column-receiving sleeve uppermost, the axis of the sleeve vertical or nearly vertical and the sleeve above the top of the column, and engaging the column in the sleeve by relative longitudinal movement between the column and support structure.

2. A method as claimed in claim 1 in which the support structure further includes means for laterally locating the lower end of the column, and assembly of the column and support structure comprises engaging the column with first one of the sleeve and the locating means and then the other of the sleeve and the locating means.

3. A method as claimed in claim 2, wherein the locating means comprises a second sleeve arranged coaxially with said first-mentioned sleeve, and said step of engaging the column with the locating means comprises introducing the lower end of the column into the second sleeve from above the second sleeve, and positioning the column in the second sleeve by relative longitudinal movement of the column and support structure.

4. A method as claimed in claim 2 wherein the locating means comprises an openable and closable collar, and the column is engaged with the locating means by relative lateral movement between the column and collar.

5. A method as claimed in claim 2 wherein the support structure comprises a bracing structure extending between the legs and between the legs and the locating means, and the bracing structure includes an openable and closable collar arranged coaxially with and intermediate the first sleeve and the locating means, and assembling together of the column and support structure includes the step of engaging the column with the collar in between said first and second column engaging steps.

6. A method as claimed in claim 1 in which foundation means is provided with means for laterally locating the lower end of the column, and said method comprises the steps of pre-installing the foundation means on the sea bed, assembling together the column and support structure, and lowering the assembled column and support structure onto the foundation means so that the lower end of the column engages with the locating means.

7. A method as claimed in claim 1 wherein the column and support structure comprise hollow tubular members, and positioning and movement of the column and support structure is effected by ballasting/debal-lasting of the column and support structure members.

8. A method as claimed in claim 1 further including the step of providing a crane vessel or vessels with means to effect or assist with positioning and movement of the column and/or support structure.

9. A method as claimed in claim 1 further including the step of temporarily providing on the support structure means to effect or assist with the step of engaging the column with the support structure.

* * * * *